US010619866B2

(12) United States Patent
Janesky

(10) Patent No.: US 10,619,866 B2
(45) Date of Patent: Apr. 14, 2020

(54) DEHUMIDIFIER APPARATUS

(71) Applicant: Tanner Janesky, Middlebury, CT (US)

(72) Inventor: Tanner Janesky, Middlebury, CT (US)

( * ) Notice: Subject to any disclaimer, the term of this patent is extended or adjusted under 35 U.S.C. 154(b) by 716 days.

(21) Appl. No.: 15/230,088

(22) Filed: Aug. 5, 2016

(65) Prior Publication Data

US 2018/0038602 A1 Feb. 8, 2018

(51) Int. Cl.

| | |
|---|---|
| ***F25D 23/00*** | (2006.01) |
| ***F24F 3/14*** | (2006.01) |
| ***F24F 13/22*** | (2006.01) |
| ***F24F 13/20*** | (2006.01) |
| ***F24F 3/153*** | (2006.01) |
| *F24F 3/16* | (2006.01) |
| *F24F 110/22* | (2018.01) |

(52) U.S. Cl.

CPC ..... *F24F 3/1405* (2013.01); *F24F 3/153* (2013.01); *F24F 13/20* (2013.01); *F24F 13/222* (2013.01); *F24F 2003/1667* (2013.01); *F24F 2110/22* (2018.01)

(58) Field of Classification Search

CPC ..... F25D 21/14; F25D 2321/00; F25D 5/009; F24F 3/1405; F24F 3/153; F24F 13/20; F24F 13/222; F24F 2003/1667; F24F 2110/22; B01D 5/009; E03B 3/28

See application file for complete search history.

(56) References Cited

U.S. PATENT DOCUMENTS

| | | | | |
|---|---|---|---|---|
| 5,318,099 | A * | 6/1994 | Zivalich, Jr. ..... | F24F 1/0007 165/245 |
| 7,246,503 | B1 * | 7/2007 | O'Brien ..... | B01D 53/265 62/272 |
| 8,938,981 | B2 | 1/2015 | Dingle et al. | |
| 2017/0028407 | A1 * | 2/2017 | Fairbank, Jr. ..... | B03C 3/019 |

* cited by examiner

*Primary Examiner* — Henry T Crenshaw
*Assistant Examiner* — Kamran Tavakoldavani
(74) *Attorney, Agent, or Firm* — Perman & Green, LLP

(57) ABSTRACT

A dehumidifier apparatus including a frame defining an air inlet, the air inlet configured for receiving unconditioned air, an evaporator unit connected to the frame and in communication with the air inlet, a condenser unit connected to the frame and in communication with the air inlet, and a condensation collection tray connected to the frame, wherein the air inlet has an evaporator air inlet portion and a bypass air inlet portion directing a bypass airflow away from the evaporator unit to the condenser unit so that the bypass airflow flows to the condenser unit bypassing the evaporator unit, wherein the condensation collection tray is disposed in the air inlet in contact with the bypass air inlet portion.

27 Claims, 6 Drawing Sheets

DEHUMIDIFIER APPARATUS

BACKGROUND

1. Field

The exemplary embodiments generally relate to dehumidifiers, more particularly, compact dehumidifiers.

2. Brief Description of Related Developments

Conventional dehumidifiers include a housing having a fan to create an air flow, a catch basin within the housing and, means for cooling the flow of air to condense the moisture in the air flow for collection of moisture in the catch basin. Dehumidifiers are frequently used in residential, commercial, or industrial applications to reduce the level of humidity in the air, for example, for health reasons or comfort reasons. Humid air can cause unwanted mold or mildew to grow inside, for example, homes or workplaces or can simply be uncomfortable at extremely warm temperature. Dehumidifiers are also frequently used in, for example, restoration projects to dry an area affected by water damage, such as being flooded, as the drier air helps in the restoration of buildings or other structures. Some of these conventional dehumidifiers are rather complex which lack, among others, simplicity and efficiency.

It would, therefore, be desirable to provide a relatively compact dehumidifier that is reliable and efficient in removing moisture from the air and providing increased air quality compared to conventional dehumidifiers.

BRIEF DESCRIPTION OF THE DRAWINGS

The foregoing aspects and other features of the disclosed embodiment are explained in the following description, taken in connection with the accompanying drawings, wherein.

DETAILED DESCRIPTION

Figure 1:
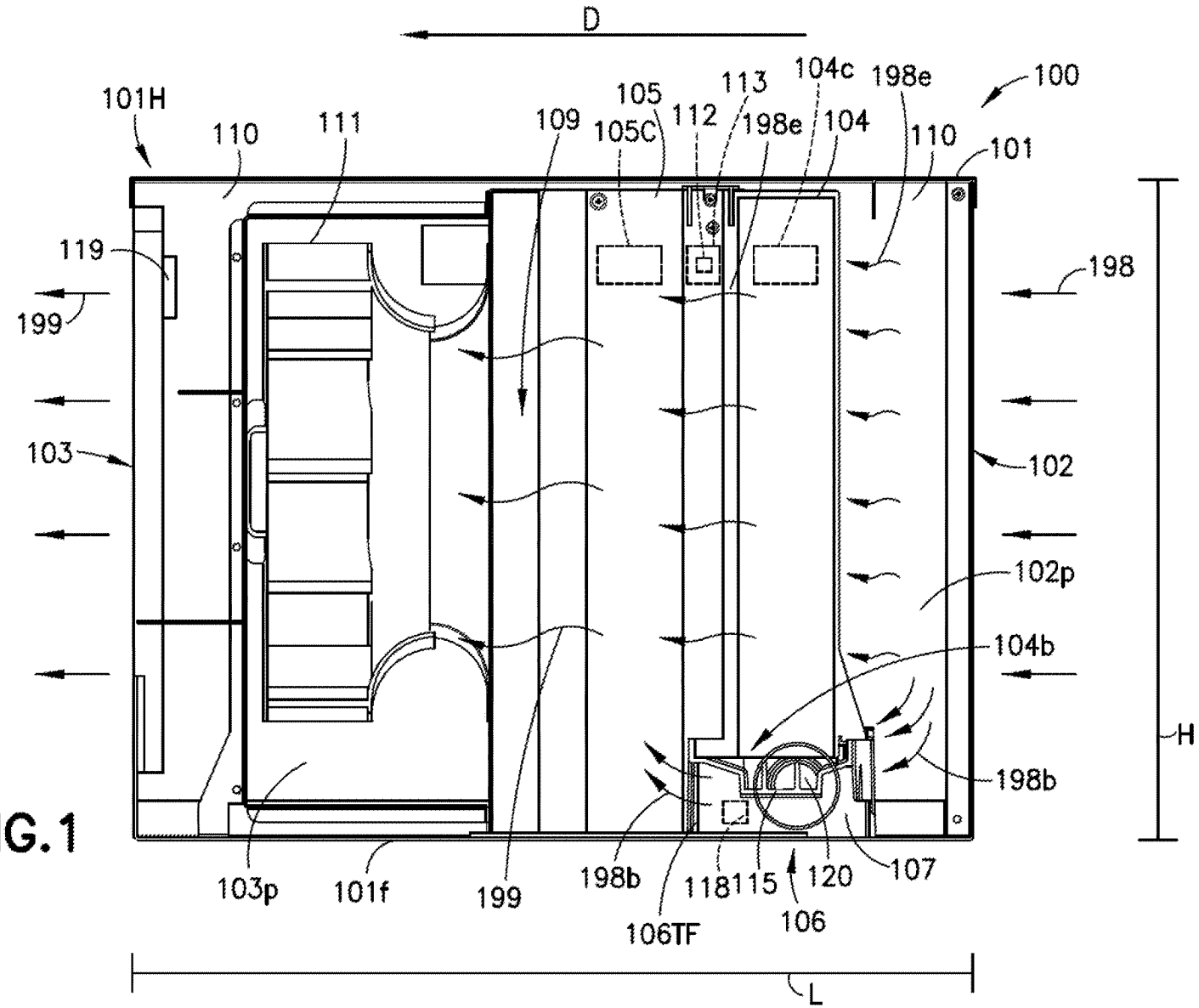
FIG. 1 is a schematic illustration of a dehumidifier according to one or more aspects of the present disclosure.
Figure 2A:
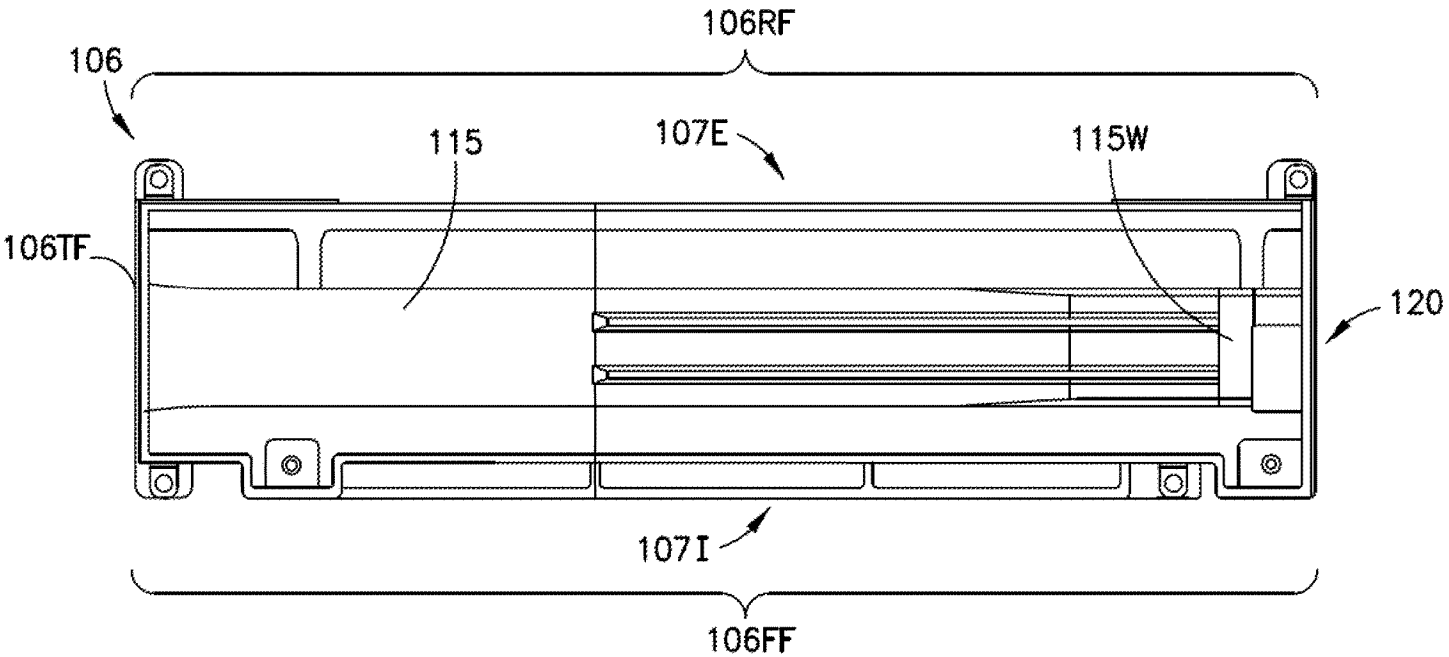
FIGS. 2A-2E are schematic illustrations of a portion of the dehumidifier according to one or more aspects of the present disclosure.
Figure 2B:
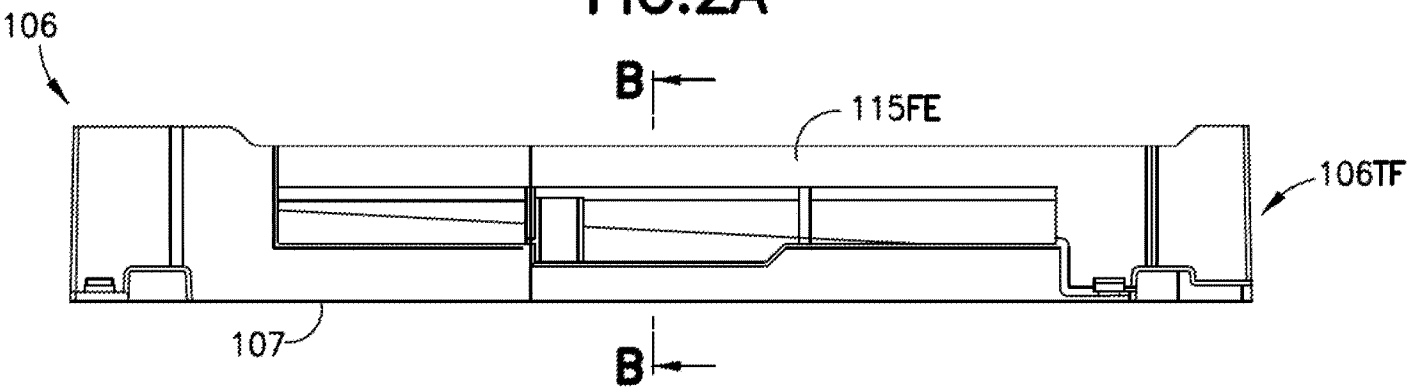
Figure 2C:
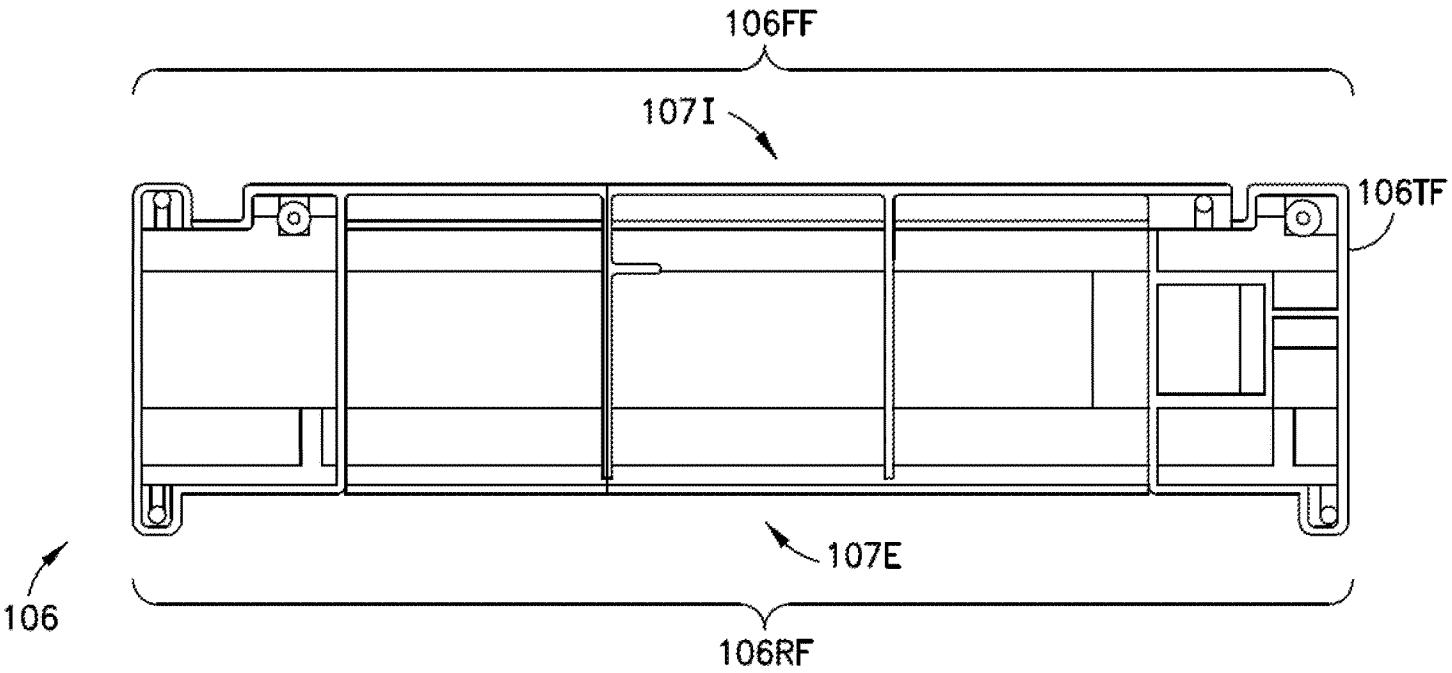
Figure 2E:
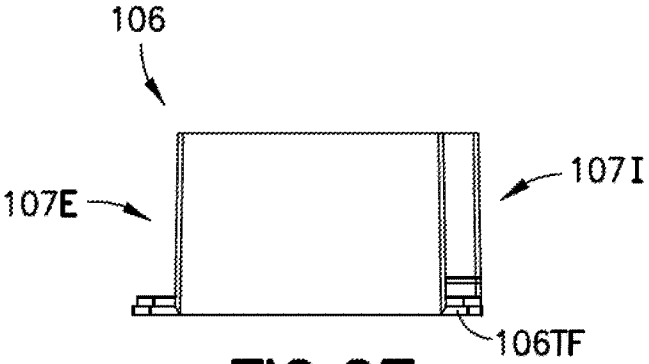
Figure 2D:
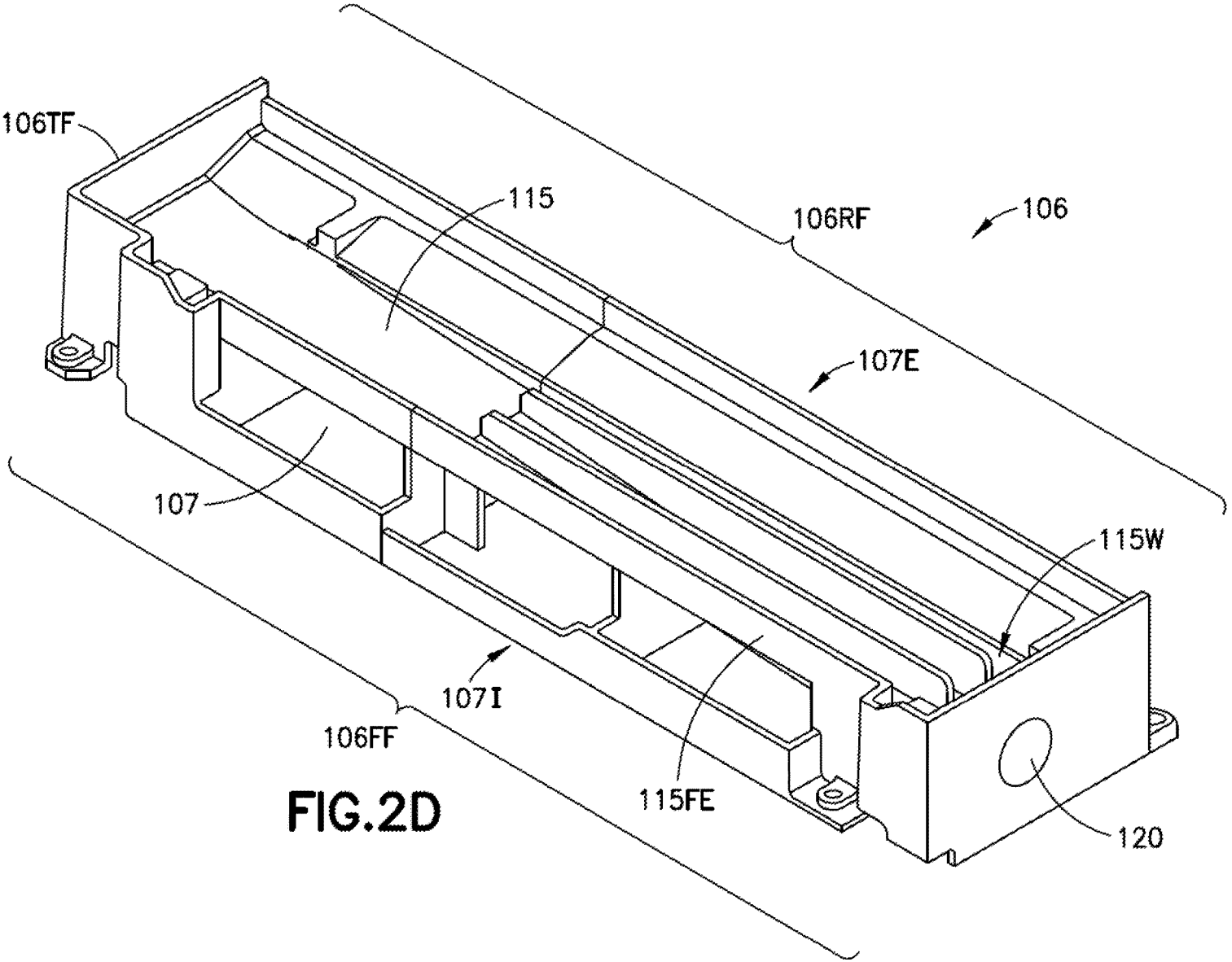
Figure 3:
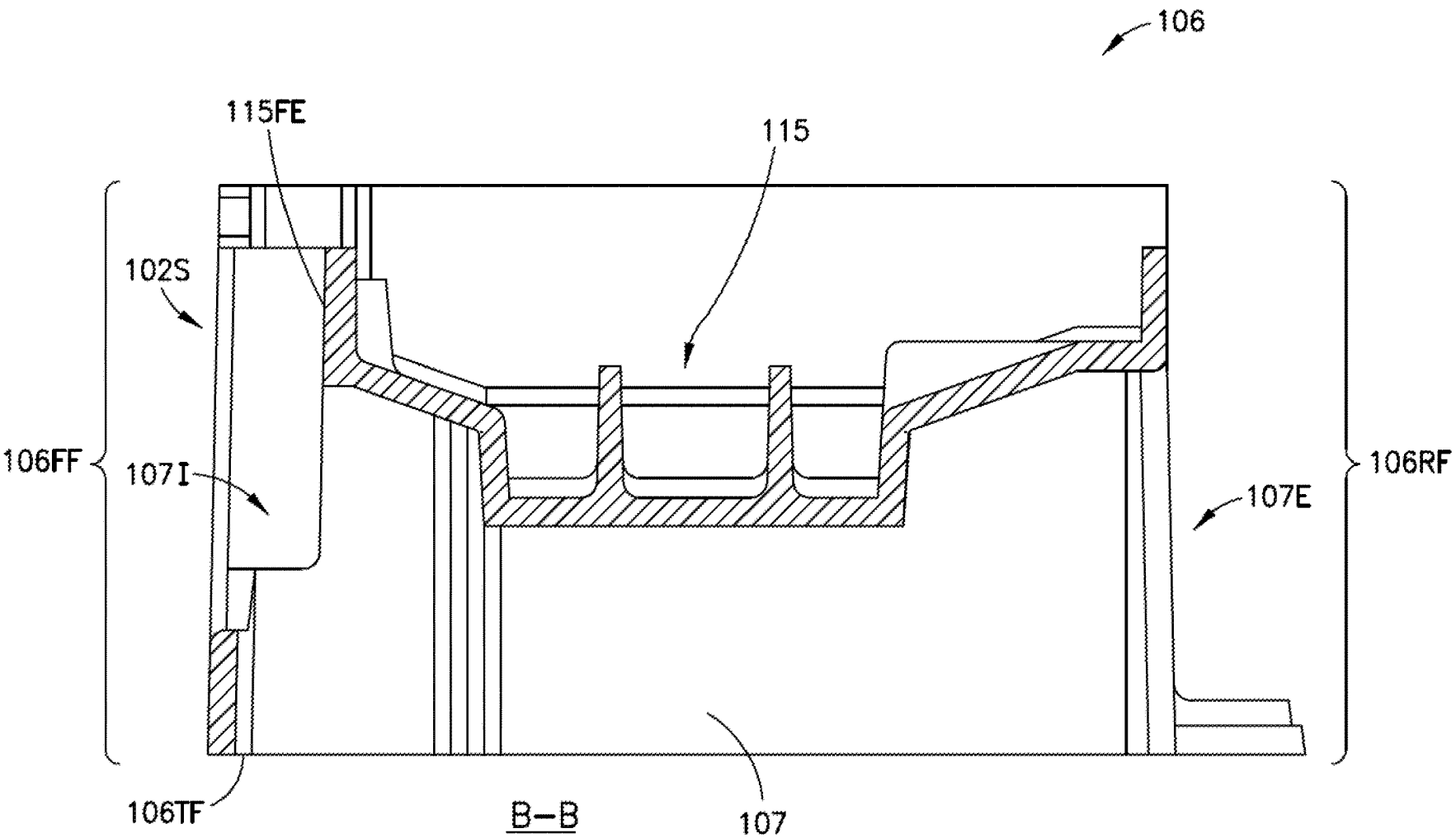
FIG. 3 is a schematic illustration of a portion of the dehumidifier according to one or more aspects of the present disclosure.

FIG. 1 illustrates a dehumidifier apparatus 100 in accordance with aspects of the disclosed embodiment. Although the aspects of the disclosed embodiment will be described with reference to the drawings, it should be understood that the aspects of the disclosed embodiment can be embodied in many forms. In addition, any suitable size, shape or type of elements or materials could be used.

Referring to FIG. 1, the aspects of the present disclosure described herein provide for a dehumidifier apparatus 100. The dehumidifier apparatus 100 configured for reducing humidity of unconditioned air 198.

The dehumidifier apparatus 100 is configured to draw unconditioned air 198 into the apparatus. In one aspect, a portion of the unconditioned air 198 (i.e., a bypass airflow) is directed away from an evaporator unit 104 to one of a mixing plenum 113, a condenser unit 105 or an exhaust plenum 103P, so that the bypass airflow bypasses the evaporator unit 104.

Still referring to FIG. 1, the dehumidifier apparatus 100 generally includes a frame 101, forming a housing 101H of the dehumidifier apparatus 100, the frame 101 being configured to house the parts of the dehumidifier 100 as will be described herein.

The dehumidifier apparatus 100 also includes the evaporator unit 104, the condenser unit 105, a compressor 109, a condensation collection tray 106, a supply fan 111, and a bypass passage 107, in one aspect all disposed within the housing 101H and connected to the frame 101.

In one aspect, the frame 101 is configured as a compact frame, as will be further described herein, such that the evaporator unit 104, the condenser unit 105 and the condensation collector tray 106 are all within and in communication with air inlet 102. In one aspect, the frame 101 may be any suitable shape or size.

In one aspect, the frame 101 defines the air inlet 102 and an air outlet 103. The air inlet 102 is configured, for example, for receiving unconditioned air 198 into the housing 101H, while the air outlet 103 is configured, for example, for dispersing dehumidified air 199 from the housing 101H. In one aspect, the air inlet 102 and the air outlet 103 are located on opposite sides of the housing 101H, such that an unimpeded direction of airflow B is parallel to a floor 101F of the housing 101H throughout. In one aspect, the air inlet 102 and the air outlet 103 may be located in any suitable position in the housing 101H. In one aspect, the air inlet 102 and the air outlet 103 span approximately the entire height H of the housing 101H, while in another aspect, the air inlet 102 and air outlet 103 may span any suitable amount of the height H of the housing 101H.

In one aspect, the air inlet 102 is merely an aperture or hole in the housing 101H, such that unconditioned air 198 may enter through the aperture into an interior 110 of the housing 101H. In other aspects, the air inlet 102 may have a filter or may include the supply fan 111, supplied to draw the unconditioned air 198 into the housing 101H. The air inlet 102 may be formed in any other suitable manner.

In one aspect, the air outlet 103, similar to air inlet 102, is an aperture or hole in the housing 101H, such that dehumidified air 199 is dispersed through the aperture from the interior 110 of the housing 101H. In other aspects, the air outlet 103 may have a filter or may include supply fan 111 supplied to draw the dehumidified air 199 from the housing 101H. The air outlet 103 may be formed in any suitable manner.

Still referring to FIG. 1, in one aspect, unconditioned air 198 is drawn into the interior 110 of the housing 101H through the air inlet 102 and integrated in an inlet plenum 102P. From the inlet plenum 102P the unconditioned air 198 is directed towards both the evaporator unit 104 and the bypass passage 107. In one aspect, the interior 110 may not have an inlet plenum 102P and the unconditioned air 198 may be directly drawn into one of the evaporator unit 104 or the bypass passage 107. In one aspect, the frame 101 may have two separate, independent air inlets, each inlet independently drawing in unconditioned air 198 to the evaporator unit 104 and the bypass passage 107. The bypass air 198*b* and the evaporator air 198*e* are split outside of the housing 101H as they are drawn into the separate independent air inlets.

In one aspect, the condensation collection tray 106 is coupled to a bottom 104*b* of the evaporator unit 104. In one aspect, the condensation collection tray may be disposed in any suitable manner to collect condensation from the evaporator unit 104.

In one aspect, the evaporator unit 104, the condenser unit 105, and condensation collection tray 106 are all in communication with the air inlet 102. In one aspect, the evaporator unit 104 with the condensation collection tray 106 coupled to the bottom 104B and the condenser unit 105 are placed directly inline between the air inlet 102 and the air outlet 103. In one aspect, the evaporator unit 104 with the condensation collection tray 106 coupled to the bottom 104B and the condenser unit 105 span approximately the height H of the housing 101H such that the frame 101 and housing 101H are in a compact configuration. In one aspect, the compact configuration is configured such that the plenum between the evaporator unit 104 and the condenser unit 105 has a length corresponding generally to a length of the evaporator coils or less and has no heat exchange core inside. In one aspect, the evaporator unit 104 with the condensation collection tray 106 coupled to the bottom 104B and the condenser unit 105 span any portion of the height H of the housing 101H.

The evaporator unit 104 and the condenser unit 105 are generally a conventional evaporator and condenser provided to dehumidify the unconditioned air 198. The evaporator unit 104 and the condenser unit 105 being connected to compressor 109 which is a conventional compressor.

Still referring to FIG. 1, in one aspect, the supply fan 111 is generally disposed inline with the evaporator unit 104 and the condenser unit 105. In one aspect, the supply fan is located in one of an inlet plenum 102P and an exhaust plenum 103P in order to draw the unconditioned air 198 in and disperse the dehumidified air 199 out of the housing 101H. In one aspect, the supply fan 111 is configured to draw unconditioned air 198 into the housing 101H and dispense dehumidified air 199 out of the housing 101H.

Referring now to FIGS. 1, 2A-2E, and 3, the condensation collection tray 106 is generally configured for collecting wafer condensation from the unconditioned air 198 being dehumidified in the evaporator unit 104. In one aspect, the condensation collection tray 106 forms the bypass passage 107. The bypass passage 107 is configured as a bypass route for a portion of the unconditioned air 198 entering the air inlet 102 to bypass the evaporator unit 104, such that the bypass air 198*b* is not subject to cooling and dehumidification of the evaporator unit 104.

In one aspect, the condensation collection tray 106 generally includes a tray frame 106TF having a tray front face 106FF and a tray rear face 106RF, the tray frame forming a collection channel 115 and a collection well 115W and defining a drain 120. In one aspect, the tray frame 106TF is formed with plastic, metal, or any other suitable material.

As described above, the condensation collection tray 106 may be positioned in the air inlet 102 and coupled to the bottom 104B of the evaporator unit 104, configured to collect the water condensation produced by the unconditioned air 198 passing over the evaporator coils 104C of the evaporator unit 104. The collection channel 115, the tray front face 106FF, and tray rear face 106RF generally have a concave cross section with respect to the longitudinal section L of the dehumidifier apparatus 100. The condensation collection tray 106 is generally a gravity drain such that the water condensation is drawn down from the evaporator unit 104 to the condensation collection tray 106 by the force of gravity. The collection channel 115 collects the water drawn down by gravity. In one aspect, the collection channel 115 is formed in a pitched orientation relative to the floor 101F of the housing 101H. The pitched orientation further directs the water condensation down the collection channel 115 and into the collection well 115W from which the water condensation may exit out of the housing 101H through the drain 120 by the force of gravity. In one aspect, the collection channel 115 and collection well 115W may be formed in any manner suitable to draw the water out of the drain 120. For example, the collection channel 115, collection well 115W and drain 120 may be configured as a force drain (e.g., suction or a sump pump drawing the water out), forcing the water down the collection channel 115 and out of the drain 120.

In one aspect, the condensation collection tray 106 is configured as an air inlet splitter 102S to split the unconditioned air 198 into evaporator air 198*e* and bypass air 198*b*. In one aspect, the tray frame 106TF defines the air inlet splitter 102S. In one aspect, the front edge 115FE of the collection channel 115 forms the air inlet splitter 102S. In one aspect, the bottom 104B of the evaporator unit 104 forms the splitter. In one aspect, the air inlet splitter 102S is in communication with the bypass passage 107 which together form the airflow bypass.

Still referring to FIGS. 1, 2A-2E, and 3, in one aspect, the collection channel 115 is interposed between the evaporator unit 104, evaporating the evaporator air 198*e*, and the bypass passage 107, where the bypass air 198*b* flows.

In one aspect, the tray frame 106FF defines a bypass passage inlet 107I and a bypass passage exhaust 107E, such that the air inlet splitter 102S, the bypass passage inlet 107I, the bypass passage exhaust 107E, and the collection channel 115 define the bypass passage 107.

In one aspect, the tray front face 106FF includes air inlet splitter 102S and the bypass passage inlet 107I. In one aspect, the tray front face 106FF is positioned upstream with respect to the evaporator unit 104 and in communication with the air inlet 102 or the inlet plenum 102P where the unconditioned air 198 integrates before being split into evaporator air 198*e* and bypass air 198*b*. In one aspect, the tray rear face 106RR includes a bypass passage exhaust 107E. In one aspect, the tray rear face 106RR is positioned downstream of the evaporator unit 104 such that the bypass air 198*b* is exhausted from the bypass passage 107 into the condenser unit 105 to mix with the evaporator air 198*e*. In one aspect, the bypass passage exhaust 107E may exhaust the bypass air 198*b* into an exhaust plenum 103P to be mixed with the evaporator air 198*e* downstream of the condenser unit 105.

In one aspect, disposed between the evaporator unit 104 and the condenser unit 105 is the mixing plenum 113. The mixing plenum 113 provided downstream of the evaporator unit 104 such that the bypass air 198*b* may be exhausted into the mixing plenum 113, mixing with the evaporator air 198*e* after the evaporator air 198*e* passes through the evaporator unit 104, such that the evaporator air 198*e* and the bypass air 198*b* are drawn through the condenser unit 105 together after mixing.

Still referring to FIGS. 1, 2A-2E, and 3, in one aspect, the bypass passage inlet 107I is configured as a low pressure or suction region. The low pressure/suction region reduces the static pressure of the condensation collection tray 106. The low pressure/suction region generally provides an increase in the effectiveness of the gravity drain, such that the low pressure increases drainage flow from the evaporator unit 104 which increases drainage flow in the collection channel 115.

Referring again to FIG. 1, in one aspect, the dehumidifier apparatus 100 also includes an ultraviolet illumination plenum 112. In one aspect, the ultraviolet illumination plenum 112 is defined by the housing 101H, for example, as a window. In other aspects, the ultraviolet illumination plenum 112 may be one or more ultraviolet bulbs. The ultraviolet illumination plenum 112 is configured as antifungal and/or antibacterial protection such that promotion of growth is reduced by the introduction of an ultraviolet light source. The ultraviolet illumination plenum 112 may be positioned at the mixing plenum 113, the exhaust plenum 103P, the inlet plenum 102P, or a combination thereof.

In one aspect, the dehumidifier apparatus includes a humidity sensor 118. The humidity sensor 118 configured to provide a reading of humidity levels within the housing 101H. The humidity sensor may be positioned in any suitable location within the housing 101H including but not limited to integrated with the frame 101 in the air inlet 102, the air outlet 103, or mounted in the bypass passage 107 in the condensation collection tray 106.

In one aspect, the dehumidifier apparatus includes a controller 119. The controller 119 is configured to control the supply fan 111 and the humidity sensor 118. The controller 119 may also be configured to control power to the compressor 109 to operate the dehumidifier apparatus 100.

Figure 4:
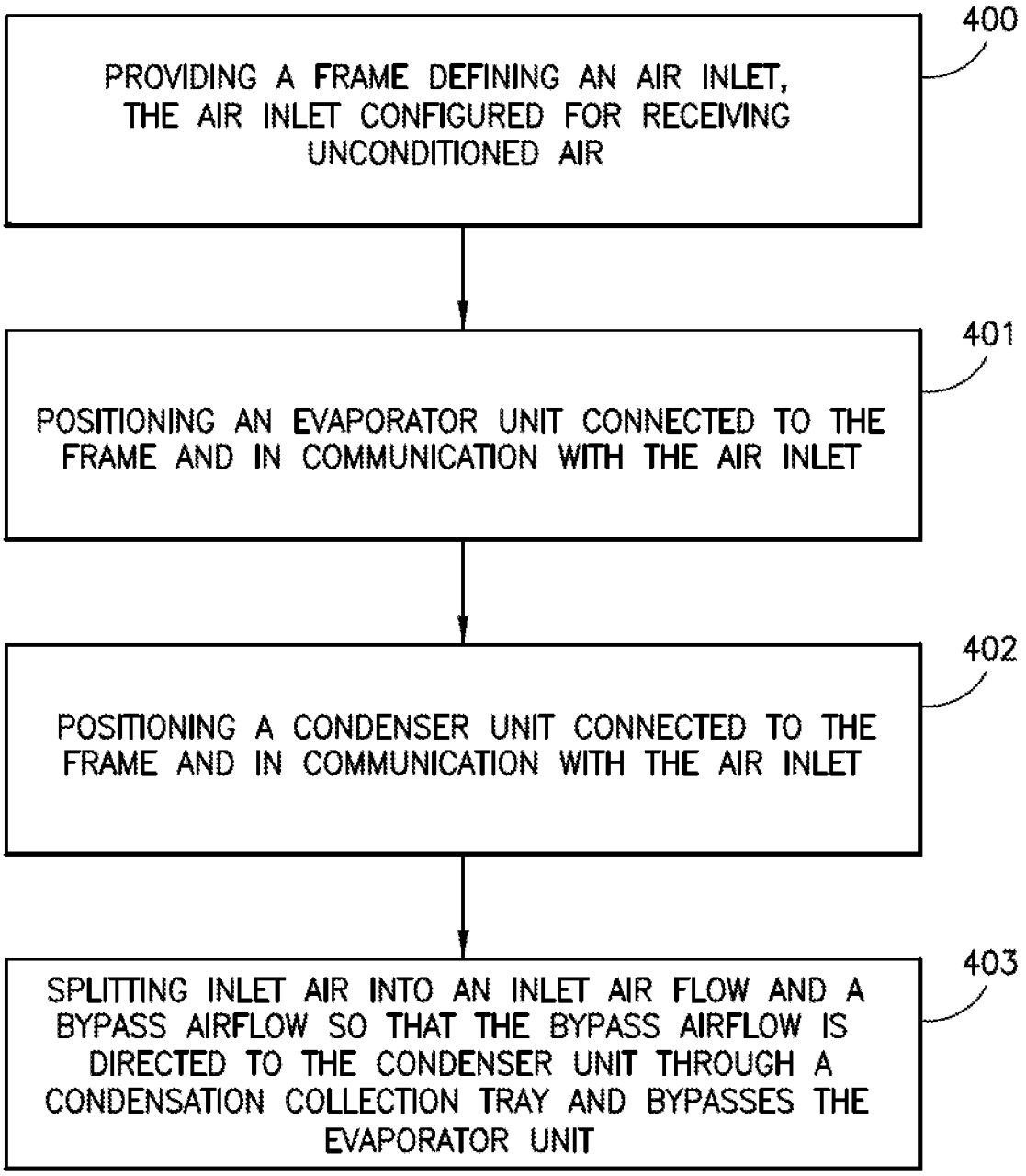
FIG. 4 is a flow diagram of a method of manufacturing a dehumidifier in accordance with one or more aspects of the present disclosure

Referring now to FIGS. 1-4, generally, the frame 101 is provided, defining the air inlet 102 to receive the unconditioned air 198 (FIG. 4, Block 400). Within the frame 101, the supply fan 111 draws the unconditioned air 198 into the air inlet 102, receiving the unconditioned air 198 into the housing 101H. Positioned in the frame 101 is the evaporator unit 104 which is in communication with the air inlet 102 (FIG. 4, Block 401). Also positioned in the frame 101 is the condenser unit 105 in communication with the air inlet 102 (FIG. 4, Block 402). The unconditioned air 198 is directed by the air inlet splitter 102S which splits the unconditioned air 198 into unconditioned evaporator air 198*e* and unconditioned bypass air 198*b* where the unconditioned bypass air 198*b* is directed to the condenser unit 105 through the condensation collection tray 106 bypassing the evaporator unit 104 (FIG. 4, Block 403).

Generally, a refrigerant such as R410A enters the compressor 109 and is compressed increasing its pressure and thus its temperature. The refrigerant is then pumped into the condenser unit 105 via a long tube called the condenser coil 105C. As the hot refrigerant flows through the condenser unit 105, it is cooled by cold air flowing over the condenser coils 105C (heating the air). The refrigerant then runs into the evaporator unit 104 via an evaporator coil 104C, where it is suddenly depressurized, causing it to become very cold. As the unconditioned evaporator air 198*e* passes through the evaporator unit 104, the air is cooled below its dew point. The water in the unconditioned evaporator air 198*e* condenses on the cold surface of the evaporator coils. The water, under the effect of gravity is pulled down towards the condensation collection tray 106 positioned beneath the evaporator unit 104. Due to the low pressure/suction region reducing the static pressure of the condensation collection tray 106 the drainage of the water is increased because of low pressure collection channel 115 increasing the diameter of drainage flow pulling the water down and out of the drain 120. The cold dry air continues through and passes over the hot coils of the condenser unit 105 which heats up the unconditioned evaporator air 198*e*. The unconditioned evaporator air 198*e* and the bypass air 198*b* are mixed to form the dehumidified air 199 which is returned to the area it was drawn from.

It should be understood that the foregoing description is only illustrative of the aspects of the disclosed embodiment. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

In accordance with one or more aspects of the disclosed embodiment, a dehumidifier apparatus is provided. The dehumidifier apparatus comprising a frame defining an air inlet, the air inlet configured for receiving unconditioned air, an evaporator unit connected to the frame and in communication with the air inlet, a condenser unit connected to the frame and in communication with the air inlet, and a condensation collection tray connected to the frame, wherein the air inlet has an evaporator air inlet portion and a bypass air inlet portion directing a bypass airflow away from the evaporator unit to the condenser unit so that the bypass airflow flows to the condenser unit bypassing the evaporator unit, and wherein the condensation collection tray is disposed in the air inlet in contact with the bypass air inlet portion.

In accordance with one or more aspects of the disclosed embodiment, wherein the dehumidifier apparatus has a compact configuration.

In accordance with one or more aspects of the disclosed embodiment, wherein the condensation collection tray has an integral bypass air passage defining, at least in part, the bypass air inlet portion.

In accordance with one or more aspects of the disclosed embodiment, wherein the condensation collection tray includes walls forming a condensation collection surface, the walls separating the bypass airflow from the evaporator unit, and a collection channel disposed within the bypass airflow.

In accordance with one or more aspects of the disclosed embodiment, wherein the condensation collection tray has a concave longitudinal cross section along a direction of airflow through the bypass air inlet portion.

In accordance with one or more aspects of the disclosed embodiment, wherein the bypass air inlet portion is shaped to form suction within the bypass air inlet portion.

In accordance with one or more aspects of the disclosed embodiment, the dehumidifier apparatus further comprising an ultraviolet illumination plenum configured to provide ultraviolet rays to an interior of the dehumidifier apparatus.

In accordance with one or more aspects of the disclosed embodiment, wherein the condensation collection tray forms a bypass air duct from the bypass air inlet portion to an exhaust of the bypass airflow to the condenser.

In accordance with one or more aspects of the disclosed embodiment, the dehumidifier apparatus further comprising a humidity sensor mounted to the condensation collection tray in the bypass airflow.

In accordance with one or more aspects of the disclosed embodiment, a dehumidifier apparatus is provided. The dehumidifier apparatus comprising a frame defining an air inlet, the air inlet configured for receiving unconditioned air, an evaporator unit connected to the frame and in communication with the air inlet, a condenser unit connected to the frame and in communication with the air inlet, and a condensation collection tray connected to the frame, wherein the condensation collection tray forms a bypass air inlet splitter in the air inlet, splitting a bypass airflow away from the evaporator unit to the condenser unit so that the bypass airflow flows to the condenser unit bypassing the evaporator unit, and wherein the condensation collection tray is disposed in the air inlet.

In accordance with one or more aspects of the disclosed embodiment, wherein the dehumidifier apparatus has a compact configuration.

In accordance with one or more aspects of the disclosed embodiment, wherein the condensation collection tray has an integral bypass air passage defining, at least in part, the bypass air inlet splitter.

In accordance with one or more aspects of the disclosed embodiment, wherein the condensation collection tray includes walls forming a condensation collection surface, the walls separating the bypass airflow from the evaporator unit, and a collection channel disposed within the bypass airflow.

In accordance with one or more aspects of the disclosed embodiment, wherein the condensation collection tray has a concave longitudinal cross section along a direction of airflow through the bypass air inlet splitter.

In accordance with one or more aspects of the disclosed embodiment, wherein the bypass air inlet splitter is shaped to form suction within the bypass air inlet splitter.

In accordance with one or more aspects of the disclosed embodiment, the dehumidifier apparatus further comprising an ultraviolet illumination plenum configured to provide ultraviolet rays to an interior of the dehumidifier apparatus.

In accordance with one or more aspects of the disclosed embodiment, wherein the condensation collection tray forms a bypass air duct from the bypass air inlet splitter to an exhaust of the bypass airflow to the condenser.

In accordance with one or more aspects of the disclosed embodiment, the dehumidifier apparatus further comprising a humidify sensor mounted to the condensation collection tray in the bypass airflow.

In accordance with one or more aspects of the disclosed embodiment, a dehumidifier apparatus is provided. The dehumidifier apparatus comprising a frame defining an air inlet, the air inlet configured for receiving unconditioned air, an evaporator unit connected to the frame and in communication with the air inlet, a condenser unit connected to the frame and in communication with the air inlet, and a condensation collection tray connected to the frame, wherein the air inlet has a bypass air inlet splitter splitting a bypass airflow away from the evaporator unit to the condenser unit so that the bypass airflow flows to the condenser unit bypassing the evaporator unit, the bypass air inlet splitter having a wall that forms a condensation collection surface or condensation collection well, and wherein the condensation collection tray is disposed in the air inlet.

In accordance with one or more aspects of the disclosed embodiment, wherein the dehumidifier apparatus has a compact configuration.

In accordance with one or more aspects of the disclosed embodiment, wherein the condensation collection tray has an integral bypass air passage defining, at least in part, the bypass air inlet splitter.

In accordance with one or more aspects of the disclosed embodiment, wherein the condensation collection tray includes walls forming a condensation collection surface, the walls separating the bypass airflow from the evaporator unit, and a collection channel disposed within the bypass airflow.

In accordance with one or more aspects of the disclosed embodiment, wherein the condensation collection tray has a concave longitudinal cross section along a direction of airflow through the bypass air inlet splitter.

In accordance with one or more aspects of the disclosed embodiment, wherein the bypass air inlet splitter is shaped to form suction within the bypass air inlet splitter.

In accordance with one or more aspects of the disclosed embodiment, the dehumidifier apparatus further comprising an ultraviolet illumination plenum configured to provide ultraviolet rays to an interior of the dehumidifier apparatus.

In accordance with one or more aspects of the disclosed embodiment, wherein the condensation collection tray forms a bypass air duct from the bypass air inlet splitter to an exhaust of the bypass airflow to the condenser.

In accordance with one or more aspects of the disclosed embodiment, the dehumidifier apparatus further comprising a humidity sensor mounted to the condensation collection tray in the bypass airflow.

In accordance with one or more aspects of the disclosed embodiment, a method of manufacturing a dehumidifier is provided. The method comprising providing a frame defining an air inlet, the air inlet configured for receiving unconditioned air, positioning an evaporator unit connected to the frame and in communication with the air inlet, positioning a condenser unit connected to the frame and in communication with the air inlet, and splitting inlet air into an inlet air flow and a bypass airflow so that the bypass airflow is directed to the condenser unit through a condensation collection tray and bypasses the evaporator unit.

In accordance with one or more aspects of the disclosed embodiment, the method further comprising separating the bypass airflow from the evaporator unit with a wall of the condensation collection tray, and collecting condensation with a collection channel disposed within the bypass airflow.

In accordance with one or more aspects of the disclosed embodiment, the method further comprising illuminating an ultraviolet illumination plenum configured to provide ultraviolet rays to an interior of the dehumidifier.

In accordance with one or more aspects of the disclosed embodiment, the method further comprising sensing a humidity of the evaporator airflow or the bypass airflow with a humidity sensor In accordance with one or more aspects of the disclosed embodiment, the method further comprising mixing the bypass airflow and the evaporator airflow downstream from the evaporator unit, and exhausting the mixed air.

In accordance with one or more aspects of the disclosed embodiment, the method further comprising integrating a bypass air passage in the condensation collection tray defining, at least in part, a bypass air inlet splitter.

What is claimed is:

1. A dehumidifier apparatus comprising:

a frame defining an air inlet, the air inlet configured for receiving unconditioned air;

an evaporator unit connected to the frame and in communication with the air inlet;

a condenser unit connected to the frame and in communication with the air inlet; and a condensation collection tray connected to the frame;

wherein the air inlet has an evaporator air inlet portion and a bypass air inlet portion directing a bypass airflow away from the evaporator unit to the condenser unit so that the bypass airflow flows to the condenser unit bypassing the evaporator unit, and wherein the condensation collection tray is disposed in the air inlet such that a portion of the condensation collection tray is in contact with the unconditioned air entering the air inlet and the bypass air inlet portion.

2. The dehumidifier apparatus of claim 1, wherein the dehumidifier apparatus has a compact configuration.

3. The dehumidifier apparatus of claim 1, wherein the condensation collection tray has an integral bypass air passage defining, at least in part, the bypass air inlet portion.

4. The dehumidifier apparatus of claim 1, wherein the condensation collection tray includes walls forming a condensation collection surface, the walls separating the bypass airflow from the evaporator unit, and a collection channel disposed within the bypass airflow.

5. The dehumidifier apparatus of claim 1, wherein the condensation collection tray has a concave longitudinal cross section along a direction of airflow through the bypass air inlet portion.

6. The dehumidifier apparatus of claim 1, wherein the bypass air inlet portion is shaped to form suction within the bypass air inlet portion.

7. The dehumidifier apparatus of claim 1, further comprising an ultraviolet illumination plenum configured to provide ultraviolet rays to an interior of the dehumidifier apparatus.

8. The dehumidifier apparatus of claim 1, wherein the condensation collection tray forms a bypass air duct from the bypass air inlet portion to an exhaust of the bypass airflow to the condenser.

9. The dehumidifier apparatus of claim 1, further comprising a humidity sensor mounted to the condensation collection tray in the bypass airflow.

10. A dehumidifier apparatus comprising:

a frame defining an air inlet, the air inlet configured for receiving unconditioned air;

an evaporator unit connected to the frame and in communication with the air inlet;

a condenser unit connected to the frame and in communication with the air inlet; and a condensation collection tray connected to the frame;

wherein the condensation collection tray forms a bypass air inlet splitter in the air inlet, splitting a bypass airflow away from the evaporator unit to the condenser unit so that the bypass airflow flows to the condenser unit bypassing the evaporator unit, and wherein the condensation collection tray is disposed in the air inlet.

11. The dehumidifier apparatus of claim 10, wherein the dehumidifier apparatus has a compact configuration.

12. The dehumidifier apparatus of claim 10, wherein the condensation collection tray has an integral bypass air passage defining, at least in part, the bypass air inlet splitter.

13. The dehumidifier apparatus of claim 10, wherein the condensation collection tray includes walls forming a condensation collection surface, the walls separating the bypass airflow from the evaporator unit, and a collection channel disposed within the bypass airflow.

14. The dehumidifier apparatus of claim 10, wherein the condensation collection tray has a concave longitudinal cross section along a direction of airflow through the bypass air inlet splitter.

15. The dehumidifier apparatus of claim 10, wherein the bypass air inlet splitter is shaped to form suction within the bypass air inlet splitter.

16. The dehumidifier apparatus of claim 10, further comprising an ultraviolet illumination plenum configured to provide ultraviolet rays to an interior of the dehumidifier apparatus.

17. The dehumidifier apparatus of claim 10, wherein the condensation collection tray forms a bypass air duct from the bypass air inlet splitter to an exhaust of the bypass airflow to the condenser.

18. The dehumidifier apparatus of claim 10, further comprising a humidity sensor mounted to the condensation collection tray in the bypass airflow.

19. A dehumidifier apparatus comprising:

a frame defining an air inlet, the air inlet configured for receiving unconditioned air;

an evaporator unit connected to the frame and in communication with the air inlet;

a condenser unit connected to the frame and in communication with the air inlet; and a condensation collection tray connected to the frame;

wherein the air inlet has a bypass air inlet splitter splitting a bypass airflow away from the evaporator unit to the condenser unit so that the bypass airflow flows to the condenser unit bypassing the evaporator unit, the bypass air inlet splitter having a wall that forms a condensation collection surface or condensation collection well of the condensation collectin tray, and wherein the condensation collection tray is disposed in the air inlet.

20. The dehumidifier apparatus of claim 19, wherein the dehumidifier apparatus has a compact configuration.

21. The dehumidifier apparatus of claim 19, wherein the condensation collection tray has an integral bypass air passage defining, at least in part, the bypass air inlet splitter.

22. The dehumidifier apparatus of claim 19, wherein the condensation collection tray includes the walls forming the condensation collection surface or condensation collection well, the walls separating the bypass airflow from the evaporator unit, and a collection channel disposed within the bypass airflow.

23. The dehumidifier apparatus of claim 19, wherein the condensation collection tray has a concave longitudinal cross section along a direction of airflow through the bypass air inlet splitter.

24. The dehumidifier apparatus of claim 19, wherein the bypass air inlet splitter is shaped to form suction within the bypass air inlet splitter.

25. The dehumidifier apparatus of claim 19, further comprising an ultraviolet illumination plenum configured to provide ultraviolet rays to an interior of the dehumidifier apparatus.

26. The dehumidifier apparatus of claim 19, wherein the condensation collection tray forms a bypass air duct from the bypass air inlet splitter to an exhaust of the bypass airflow to the condenser.

27. The dehumidifier apparatus of claim 19, further comprising a humidity sensor mounted to the condensation collection tray in the bypass airflow.

* * * * *